US012529501B2

(12) United States Patent
Morales Martinez et al.

(10) Patent No.: US 12,529,501 B2
(45) Date of Patent: Jan. 20, 2026

(54) ACCUMULATOR FOR HEAT PUMP SYSTEMS

(71) Applicant: Rivian IP Holdings, LLC, Irvine, CA (US)

(72) Inventors: Graciela Morales Martinez, Irvine, CA (US); Kian Eisazadeh-Far, Mission Viejo, CA (US); Ming Ma, Tustin, CA (US); Jing He, Novi, MI (US); Sushant More, Irvine, CA (US)

(73) Assignee: Rivian IP Holdings, LLC, Irvine, CA (US)

( * ) Notice: Subject to any disclaimer, the term of this patent is extended or adjusted under 35 U.S.C. 154(b) by 218 days.

(21) Appl. No.: 18/447,247

(22) Filed: Aug. 9, 2023

(65) Prior Publication Data

US 2025/0052461 A1 Feb. 13, 2025

(51) Int. Cl.
*F25B 43/00* (2006.01)

(52) U.S. Cl.
CPC ..... *F25B 43/006* (2013.01)

(58) Field of Classification Search
CPC ..... F25B 43/006
See application file for complete search history.

(56) References Cited

U.S. PATENT DOCUMENTS

2017/0082333 A1 3/2017 Shimazu
2022/0205691 A1 6/2022 Spangler et al.

FOREIGN PATENT DOCUMENTS

CN 201731698 U * 2/2011
CN 102470729 A * 5/2012 ..... F25B 40/00
KR 101109634 B1 * 1/2012

* cited by examiner

*Primary Examiner* — Kun Kai Ma
(74) *Attorney, Agent, or Firm* — BAKERHOSTETLER

(57) ABSTRACT

Aspects of the disclosure relate to an accumulator bottle having a horizontal flow and a u-tube. The u-tube includes (e.g., horizontal) inlet and outlet sections at a common height to minimize a pressure drop for a vaporized refrigerant that passes through the accumulator. Providing the u-tube in a cuboid accumulator with horizontal flow increases the liquid volume capacity of the accumulator while reducing the pressure drop across the accumulator. The u-shape tube also improves oil mixing with the vaporized refrigerant by including an orifice at or near a bottom of the u-tube and within a portion of the accumulator in which liquid oil and/or refrigerant is stored.

20 Claims, 8 Drawing Sheets

ACCUMULATOR FOR HEAT PUMP SYSTEMS

INTRODUCTION

Heat pump systems are often provided in vehicles for providing heating or cooling of a passenger compartment of the vehicle.

SUMMARY

Aspects of the subject disclosure relate to an accumulator bottle having a horizontal flow and a u-tube. The u-tube may be mounted within a cuboid housing of the accumulator. The u-tube may include (e.g., horizontal) inlet and outlet sections at a common height to minimize a pressure drop for a vaporized refrigerant that passes through the accumulator. Providing the u-tube in a cuboid accumulator with horizontal flow (e.g., and connected internal chambers) may increase the liquid volume capacity of the accumulator. Providing the u-tube in a cuboid accumulator with horizontal flow may enable packaging of the accumulator bottle in a vehicle under-hood (e.g., in contrast with the difficulty of packaging a cylindrical-shape accumulator bottle). The u-shaped tube may also improve oil mixing with the vaporized refrigerant by including an orifice at or near a bottom of the u-tube and within a portion of the accumulator in which liquid oil and/or refrigerant is stored.

In accordance with aspects of the subject technology, an apparatus, is provided that includes a multi-dimensional tube for an accumulator of a heat pump system, the multi-dimensional tube including a u-shaped section that fluidly couples an inlet section of the multi-dimensional tube to an outlet section of the multi-dimensional tube and extends in a direction that is orthogonal to the inlet section and orthogonal to the outlet section. The multi-dimensional tube may also include an orifice in the u-shaped section. The inlet section may be configured to receive a vaporized refrigerant, the orifice may be configured to allow oil to flow therethrough, and the outlet section may be configured to outlet the vaporized refrigerant mixed with at least some of the oil. The inlet section and the outlet section may be configured to be mounted at a first distance from a floor of the accumulator. The orifice may be configured to be mounted at a second distance from the floor, the second distance less than the first distance. The multi-dimensional tube may also include a bleeding hole configured to be mounted at a third distance from the floor, the third distance between the first distance and the second distance within the accumulator.

The u-shaped section may also include a u-shaped bottom section; first and second parallel vertical sections fluidly coupled to opposing ends of the u-shaped bottom section; and first and second curved sections that respectively fluidly couple the first and second parallel vertical sections, respectively, to the inlet section and the outlet section.

In accordance with other aspects of the disclosure, an accumulator for a heat pump system may be provided, the accumulator including a u-tube mounted within a housing, the u-tube including an inlet section at a first distance from a floor of the housing and having an opening within the housing; an outlet section at the first distance from the floor of the housing and having an opening mounted in an outlet opening in the housing; and a u-shaped section that fluidly couples the inlet section to the outlet section and extends to a second distance from the floor, the second distance less than the first distance. The u-tube may also include an orifice in the u-shaped section.

The accumulator may also include a filter mounted over the orifice. The orifice may be mounted at a third distance from the floor, the third distance less than the first distance. The u-tube may also include a bleeding hole mounted at a fourth distance from the floor, the fourth distance between the first distance and the third distance. The housing may also include a cavity that forms a container configured to store a fluid portion of a refrigerant, and the u-tube may be configured to pass a vaporized portion of the refrigerant. The accumulator may also include the housing; an inlet opening in the housing; an outlet opening in the housing; and a first internal wall within the housing. A proximal end of the first internal wall may be attached to the housing between the inlet opening and the outlet opening and the first internal wall may be configured to guide the vaporized portion of the refrigerant through a cavity within the housing. The first internal wall may include at least one opening at or near a base thereof, the opening configured to allow liquid to pass under the first internal wall. The accumulator may also include a desiccant bag at or near a distal end of the first internal wall; and an additional inlet opening in the housing. The accumulator may be disposed in the heat pump system, and the heat pump system may be disposed in an electric vehicle.

In accordance with other aspects of the subject technology, a method is provided that includes providing a vaporized refrigerant into a horizontal inlet section of a u-tube of an accumulator of a heat pump system; providing oil into the u-tube via an orifice in a substantially vertical u-shaped section of the u-tube that fluidly couples the horizontal inlet section of the u-tube to a horizontal outlet section of the u-tube; and providing the vaporized refrigerant mixed with at least some of the oil through the horizontal outlet section of the u-tube.

The method may also include providing liquid refrigerant into the accumulator; and storing the liquid refrigerant in a portion of the accumulator through which the substantially vertical u-shaped section of the u-tube passes. The method may also include compressing the vaporized refrigerant provided through the horizontal outlet section of the u-tube to form a liquid refrigerant; and controlling, using the liquid refrigerant, a temperature of at least one of a passenger compartment or a battery of a vehicle.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, the subject technology is not limited to the specific details set forth herein and can be practiced using one or more other implementations. In one or more implementations, structures and components are shown in block diagram form in order to avoid obscuring the concepts of the subject technology.

Aspects of the subject technology described herein relate to an accumulator for a heat pump system. In one or more implementations, a heat pump system implementing an accumulator as described herein may be implemented in a vehicle, such as an electric vehicle. As described in further detail hereinafter, in one or more implementations, an accumulator as described herein may provide a reliable and robust mechanism for liquid and gas separation with a high refrigerant mass flow, a reduced pressure drop of the refrigerant across the accumulator before entering the compressor, and sufficient oil pickup to the refrigerant for lubrication before entering a compressor of a heat pump system. By controlling the oil pickup (e.g., via a pressure difference across an orifice in a u-tube within the accumulator), the operable lifetime of the compressor may be extended. By reducing the pressure drop in the refrigerant, the load on the compressor may be reduced. By reducing the compressor load, the coefficient of performance (COP) of the entire heat pump system may be improved.

Figure 1A:
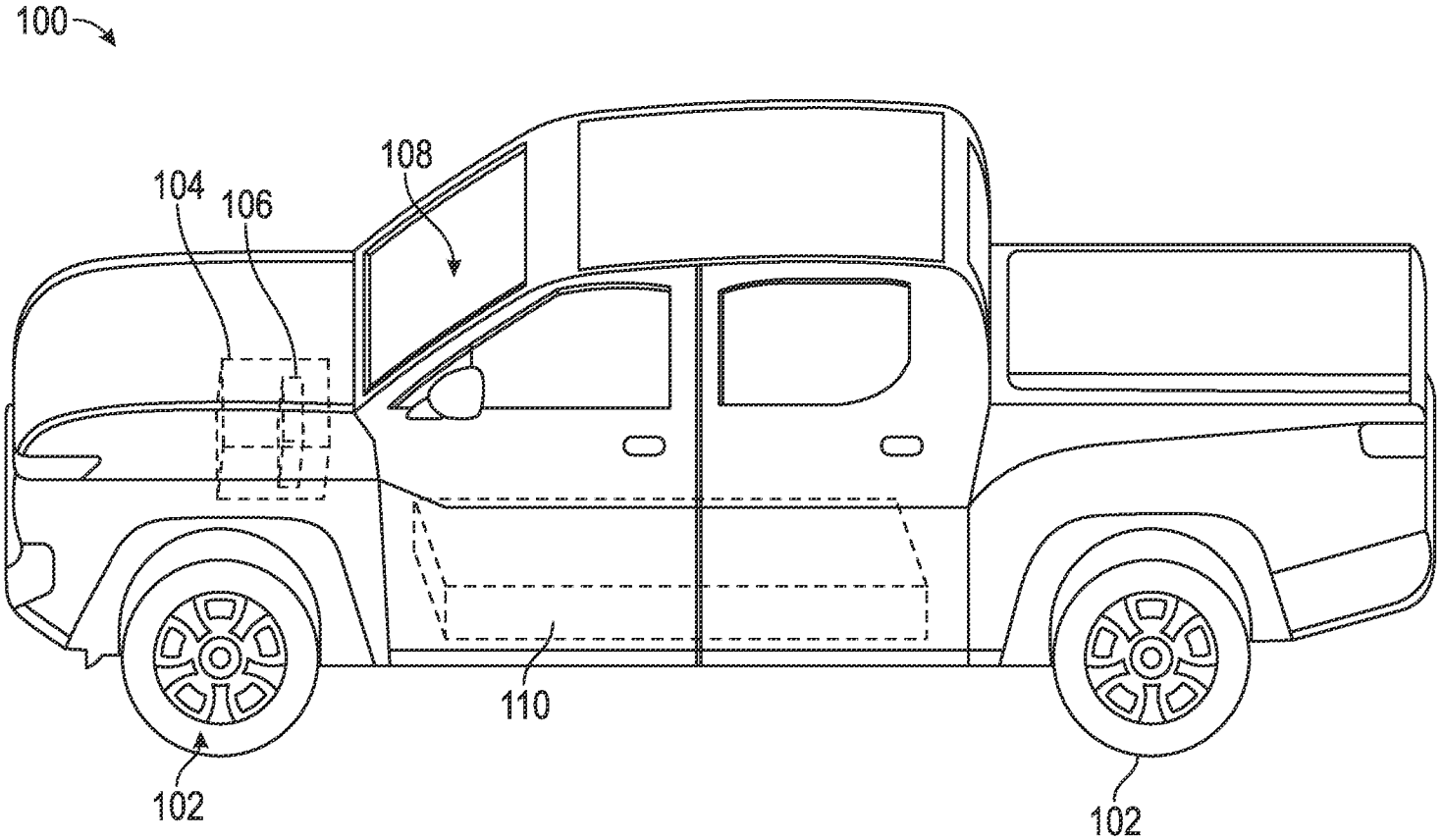
FIGS. 1A and 1B illustrate schematic perspective side views of example implementations of a vehicle having a heat pump system in accordance with one or more implementations.

FIG. 1A is a diagram illustrating an example implementation of an apparatus as described herein. In the example of FIG. 1A, the apparatus is a moveable apparatus implemented as a vehicle 100. As shown, the vehicle 100 may include one or more batteries 110. The battery 110 may include on or more battery modules, which may include one or more battery cells, or may be provided without any battery modules (e.g., in a cell-to-pack configuration).

The battery 110 may be coupled to an electrical system of the vehicle 100, to receive power for charging of the battery and/or to provide power to an electrical system of the vehicle and/or to a thermal control system, such as a heat pump system 104. As shown, the heat pump system 104 may include an accumulator 106. For example, the accumulator 106 may be configured to buffer fluids (e.g., liquid refrigerant), which could include more liquid when the head pump system 104 is used in cooling mode and less liquid when the head pump system 104 used in a heating mode. The accumulator 106 may also be configured to separate fluid refrigerant from vapor refrigerant and help ensure that fluid exits with a saturated status to a compressor (e.g., for compressor protection), and to store and pick up oil for compressor oil lubrication.

Various features of the heat pump system 104 and the accumulator 106 are described in further detail hereinafter. In one or more implementations, the heat pump system 104 may be operated to heat and/or cool various portions and/or components of the vehicle 100, such as a passenger compartment 108, the battery 110, and/or power electronics of the vehicle 100. As discussed in further detail hereinafter, in one or more implementations, the accumulator 106 may be a cuboid accumulator (e.g., having a cuboid and/or non-cylindrical housing) to allow the accumulator 106 to fit among other components of the vehicle 100, and may include a u-tube, such as to provide the cuboid accumulator with sufficient liquid storage.

In one or more implementations, the vehicle 100 may be an electric vehicle having one or more electric motors that drive the wheels 102 of the vehicle using electric power from the battery 110. In one or more implementations, the vehicle 100 may also, or alternatively, include one or more chemically powered engines, such as a gas-powered engine or a fuel cell powered motor. For example, electric vehicles can be fully electric or partially electric (e.g., hybrid or plug-in hybrid).

Figure 1B:
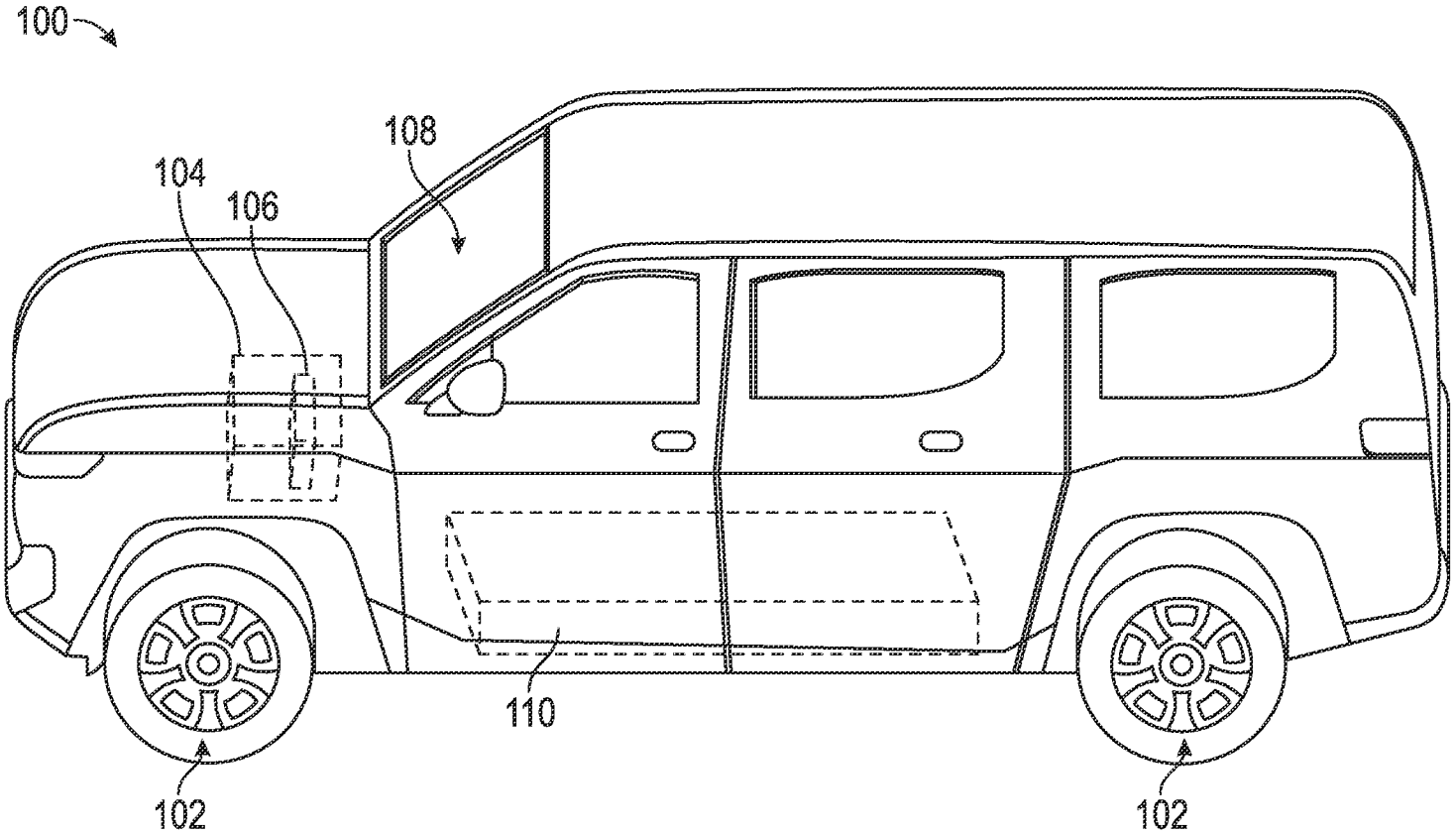

In the example of FIG. 1A, the vehicle 100 is implemented as a truck (e.g., a pickup truck) having a heat pump system 104 having an accumulator 106. However, the example of FIG. 1A in which the vehicle 100 is implemented as a pickup truck having a truck bed is merely illustrative. For example, FIG. 1B illustrates another implementation in which the vehicle 100 including the battery 110 and the heat pump system 104 including the accumulator 106 is implemented as a sport utility vehicle (SUV), such as an electric sport utility vehicle. In the example of FIG. 1B, the vehicle 100 including the battery 110 and the heat pump system 104 including the accumulator 106 may include a cargo storage area in at least a rear portion of the vehicle that is enclosed within the vehicle 100 (e.g., behind a row of seats within a cabin of the vehicle). In other implementations, the vehicle 100 may implemented as another type of electric truck, an electric delivery van, an electric automobile, an electric car, an electric motorcycle, an electric scooter, an electric passenger vehicle, an electric passenger or commercial truck, a hybrid vehicle, or other vehicles such as sea or air transport vehicles, planes, helicopters, submarines, boats, or drones, and/or any other movable apparatus having a battery 110 and a heat pump system 104 including an accumulator 106.

In one or more implementations, a heat pump system 104 including an accumulator 106 may also, or alternatively, be implemented in another apparatus, such as a building (e.g., a residential home or commercial building, or any other building).

Figure 2A:
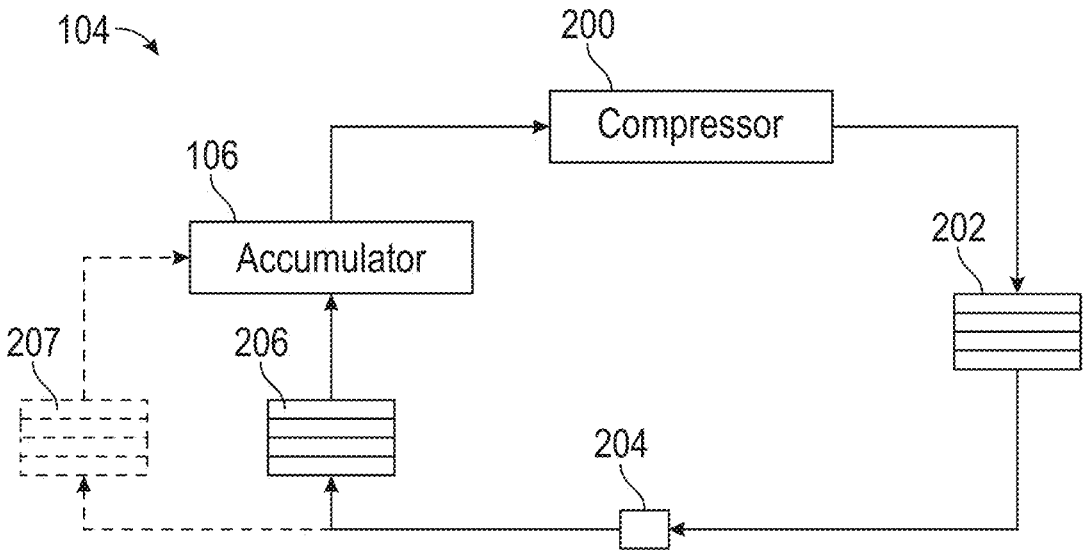
FIGS. 2A and 2B illustrate a schematic diagrams of exemplary heat pump systems in accordance with one or more implementations.
Figure 2B:
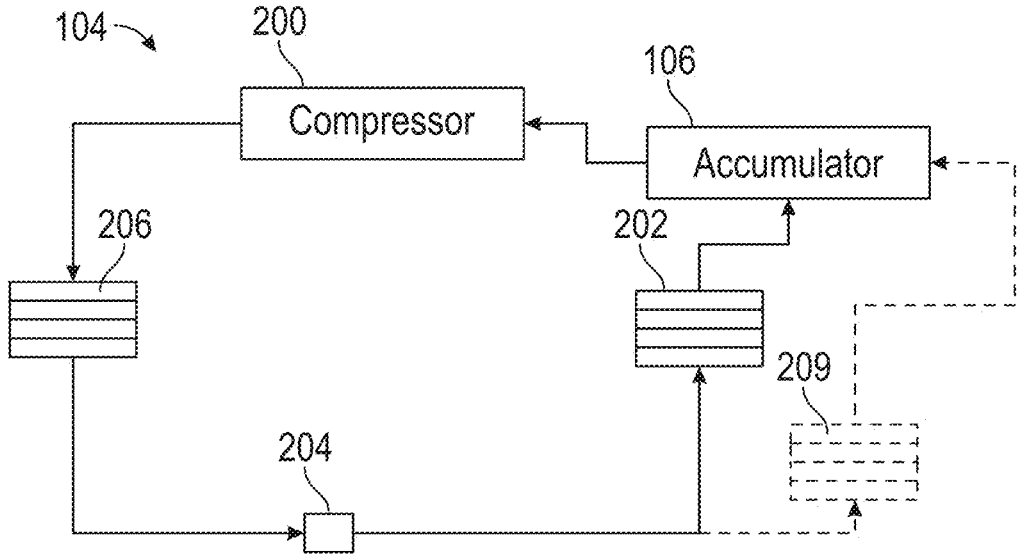

FIGS. 2A and 2B depict example configurations of a heat pump system 104 that may be implemented in an apparatus, such as the vehicle 100 of FIG. 1A or 1B, another vehicle, and/or a building or other apparatus. As shown in FIG. 2A, the heat pump system 104 may be configured as a cooling system having a compressor 200, a heat exchanger 202, an expansion valve 204, a heat exchanger 206 (e.g., that functions as an evaporator), and the accumulator 106. In the configuration of FIG. 2A, the heat pump system 104 may be used as a cooling system in which high temperature vapor refrigerant is output from the compressor 200 to the heat exchanger 202, which may transfer heat from the high temperature vapor refrigerant to, for example, outside air, causing the high temperature vapor refrigerant to condense to form a warm liquid. The warm liquid may expand upon passage through the expansion valve 204 and resultingly cool to form a cool liquid refrigerant. The cool liquid refrigerant may pass through the heat exchanger 206 (e.g., that functions as an evaporator), which transfers heat from an internal environment (e.g., passenger compartment 108) or component (e.g., battery 110 or power electronics of the vehicle 100), thereby cooling the internal environment or component and causing the cool liquid to vaporize into a warm vapor (e.g., and some warm liquid in some use cases) that is passed into the accumulator 106. As described in further detail hereinafter, the accumulator 106 may help ensure that only vaporized refrigerant (e.g., mixed with a controlled amount of oil) is then passed to the compressor 200. As described in further detail hereinafter, the accumulator 106 may be implemented as a cuboid accumulator having a u-tube.

It is appreciated that the heat pump system 104 of FIG. 2A may be a simplified depiction of a heat pump system that may include other components and/or flow paths, such as an additional (e.g., optional) flow path through another heat exchanger 207 to the accumulator 106 (e.g., to a second inlet to the accumulator 106). In this arrangement including the heat exchanger 207, the heat pump system 104 may be able to provide simultaneous cooling for multiple portions and/or components of a vehicle (e.g., a passenger compartment and a battery, a battery and a power electronics system, a passenger compartment and a power electronics system, etc.) It is also appreciated that, in one or more implementations, the heat exchanger 202 may be thermally coupled to one or more other components of a vehicle or other apparatus (e.g., rather than outside air) to providing warming of the one or more other components, such as while providing cooling using the heat exchanger 206 and/or the heat exchanger 207. In one or more implementations, the heat pump system 104 of FIG. 2A may have selectively operable flow paths and be operable to selectively provide simultaneous heating and/or cooling to two or more portions and/or components of a vehicle or other apparatus.

As shown in FIG. 2B, the heat pump system 104 may be configured as a heating system having a compressor 200, a heat exchanger 202, an expansion valve 204, a heat exchanger 206, and the accumulator 106. In the configuration of FIG. 2B, the heat pump system 104 may be used as a heating system in which high temperature vapor refrigerant is output from the compressor 200 to the heat exchanger 206, which may transfer heat from the high temperature vapor refrigerant to, for example, an internal environment (e.g., passenger compartment 108) or component (e.g., battery 110 or power electronics of the vehicle 100), thereby warming the internal environment or component and causing the high temperature vapor refrigerant to condense to form a warm liquid. The warm liquid may expand upon passage through the expansion valve 204 and resultingly cool, to form a cool liquid refrigerant. The cool liquid refrigerant may pass through the heat exchanger 202, which absorbs heat from, for example, the outside environment causing the cool liquid to vaporize into a warm vapor (e.g., and some warm liquid in one or more use cases) that is passed into the accumulator 106. As described in further detail hereinafter, the accumulator 106 may help ensure that only vaporized refrigerant (e.g., mixed with a controlled amount of oil) is then passed to the compressor 200.

It is appreciated that the heat pump system 104 of FIG. 2B may be a simplified depiction of a heat pump system that may include other components and/or flow paths, such as an additional (e.g., optional) flow path through another heat exchanger 209 to the accumulator 106 (e.g., to a second inlet to the accumulator 106). In this arrangement including the heat exchanger 209, the heat pump system 104 may be able to provide simultaneous heating for multiple portions and/or components of a vehicle (e.g., a passenger compartment and a battery, a battery and a power electronics system, a passenger compartment and a power electronics system, etc.). In one or more implementations, the heat pump system 104 of FIG. 2B may include multiple selectable flow paths and be operable to selectively provide simultaneous heating and/or cooling to two or more portions and/or components of a vehicle or other apparatus. For example, the heat pump system 104 may include any or all of the heat pump system(s) described in U.S. Patent Publication No. 2022/0396118, which is hereby incorporated herein by reference.

Figure 3:
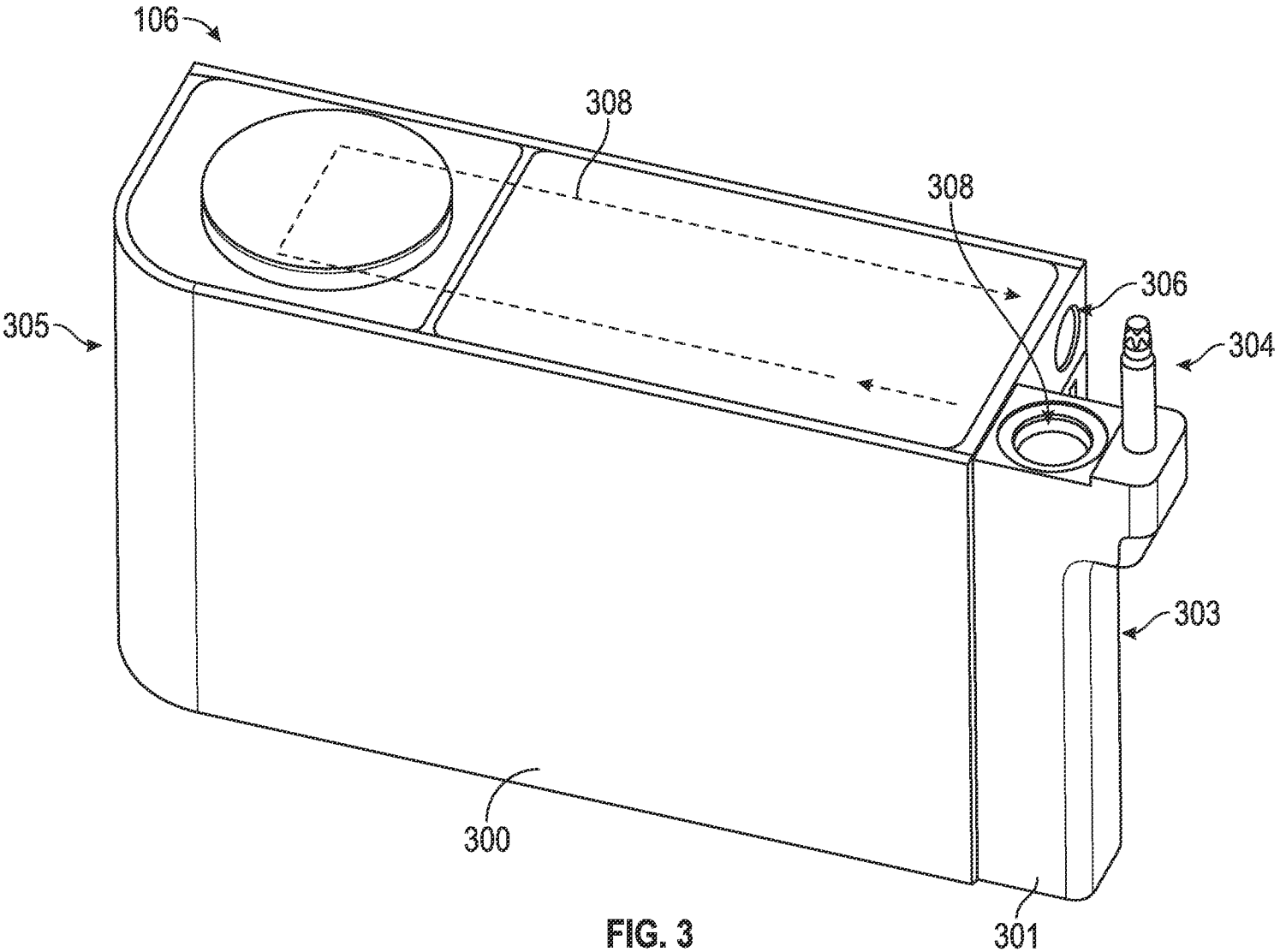
FIG. 3 illustrates a top perspective view of an example accumulator in accordance with one or more implementations.

FIG. 3 illustrates a top perspective view of the accumulator 106, in accordance with one or more implementations. As shown in FIG. 3, the accumulator 106 may include a housing 300. For example, the housing 300 may have a substantially cuboid or rectilinear (e.g., non-cylindrical) shape. This cuboid (e.g., or non-cylindrical) shape may facilitate accommodating the accumulator in another apparatus, such as the vehicle 100, along with other components of the apparatus in a confined space. As illustrated in FIG. 3, refrigerant (e.g., a vapor and/or liquid working fluid, which may also be referred to herein as a coolant in some use cases) may enter the housing 300 at a proximal end via an inlet port 302 and/or an inlet port 304 (e.g., from the heat exchanger 206 and/or the heat exchanger 207, or from the heat exchanger 202 and/or the heat exchanger 209), and may move along a flow path 308 that extends initially away from the inlet ports (e.g., toward a distal end 305 of the housing 300), and substantially reverses direction at or near the distal end 305 of the housing 300. Vapor refrigerant (e.g., mixed with a controlled amount of oil) may then exit the housing 300 at an outlet opening 306. In the example of FIG. 3, housing 300 is coupled to an inlet attachment 301 on which the inlet port 302 and the inlet port 304 are formed. In one or more other implementations, the inlet port 302 and/or the inlet port 304 may be formed directly in the housing 300 (e.g., omitting an inlet attachment 301 from the accumulator 106).

Figure 4:
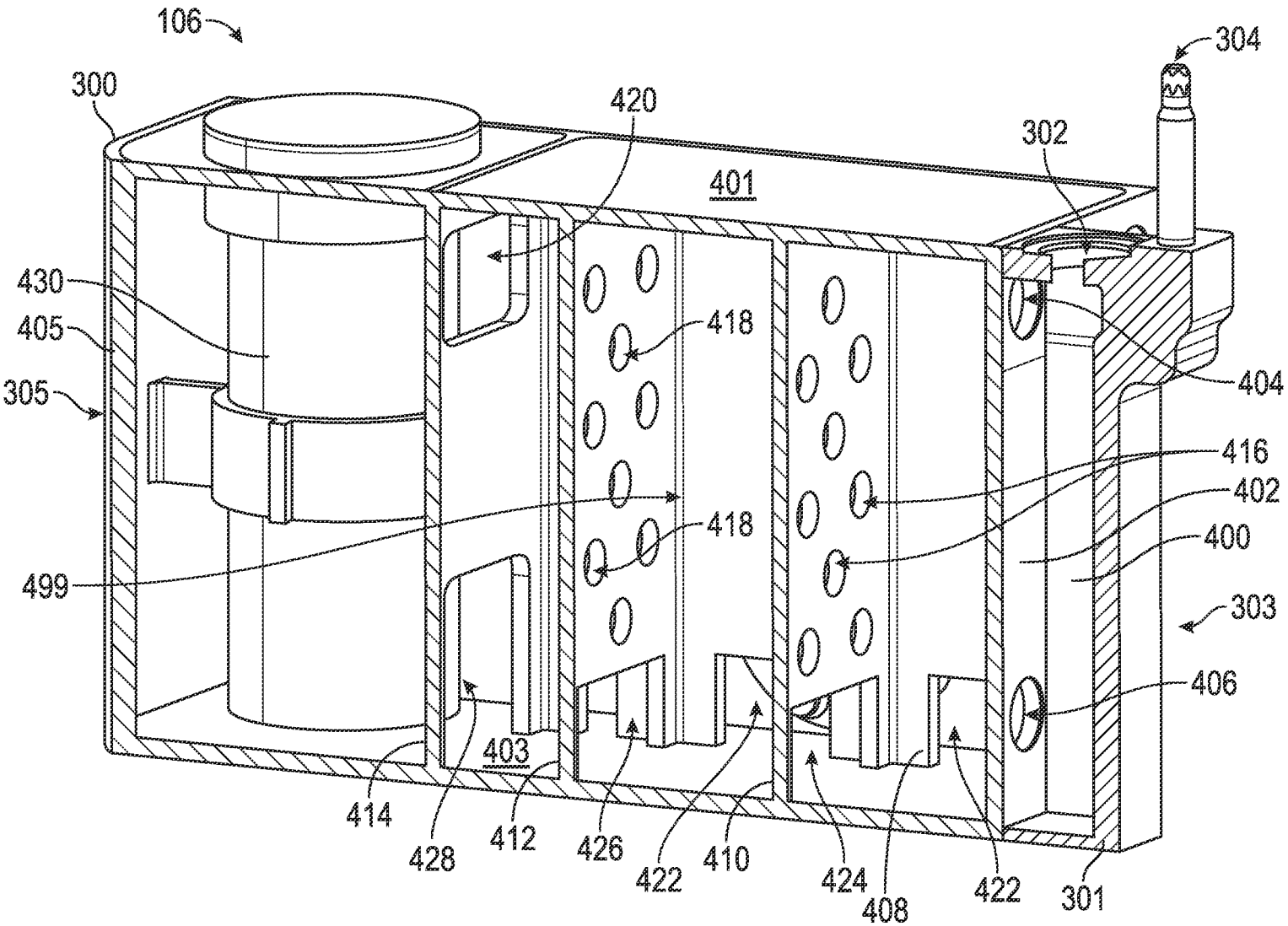
FIG. 4 illustrates a cross-sectional side perspective view of the accumulator of FIG. 3, as viewed from a first side of the accumulator in accordance with one or more implementations.

FIG. 4 illustrates a cross-sectional view of the accumulator of FIG. 3, as viewed from the same side of the accumulator 106 as in the view illustrated in FIG. 3. As shown in FIG. 4, the housing 300 may include an inlet opening 404 and/or an inlet opening 406. For example, the inlet opening 404 and/or the inlet opening 406 may be fluidly coupled to the inlet port 302 and/or the inlet port 304 via a channel 400 formed by the inlet attachment 301 and an exterior proximal wall 402 of the housing 300.

As shown in FIG. 4, the housing 300 may define a cavity 499 therewithin. The cavity 499 may form a container configured to store a liquid portion of a refrigerant. As shown, the accumulator 106 may include a first internal wall 408 within the housing 300. A proximal end of the first internal wall 408 may be attached to the housing 300 (e.g., at the proximal end 303) between the inlet opening 404 and the outlet opening 306. The first internal wall 408 may extend from the proximal end 303 of the housing 300 toward a distal end 305 of the housing at an external wall 405. In this way, the first internal wall 408 may separate and partially define an inlet portion of the flow path 308 and an outlet portion of the flow path 308, and be configured to guide a vaporized portion of the refrigerant through the cavity 499 within the housing 300. As shown, the first internal wall 408 may include at least one opening 422 at or near a base thereof. The opening 422 may be configured to allow fluid (e.g., a liquid portion of the refrigerant and/or oil) to pass under the first internal wall 408 (e.g., for storage throughout a lower portion of the cavity 499, such as on both sides of the first internal wall 408).

As shown, the accumulator 106 may include one or more additional internal walls, such as a transverse wall 410, a transverse wall 412, and/or a transverse wall 414. As shown, the transverse wall 410 may have one or more openings such as openings 416 and/or opening 424, the transverse wall 412 may include one or more openings such as openings 418 and/or opening 426, and the transverse wall 414 may include one or more openings such as an opening 420 and/or an opening 428. For example, the openings 416 in the transverse wall 410 may be misaligned with the openings 418 in the transverse wall 412. Misalignment of the openings 416 and the openings 418 may provide a baffling system that enhances a separation process of liquid droplets from the vapor refrigerant in the cavity 499 (e.g., while reducing or minimizing the pressure drop in the vaporized refrigerant). The openings 424, 426, and/or 428 may allow a liquid portion of the refrigerant to be stored throughout the lower portion of the accumulator 106. As shown, the opening 420 may be disposed in an upper portion of the transverse wall 414 to allow the vapor portion of the refrigerant to pass therethrough. As shown, the opening 420 may be a relatively large opening to avoid creating a pressurizing effect in the vaporized refrigerant.

As shown in FIG. 4, the accumulator 106 may include a desiccant bag 430 at or near a distal end of the first internal wall 408 and/or at or near a distal end of the housing 300. The desiccant bag may reduce moisture (e.g., water vapor) in the heat pump system 104, and/or prevent icing in some use cases. In the example of FIG. 4, the inlet side of the accumulator 106 that is visible in FIG. 4 includes three tanks (e.g., defined by the transverse wall 410, the transverse wall 412, and the transverse wall 414) before the refrigerant flow hits the desiccant bag 430. However, in one or more other implementations, the accumulator 106 may be provided without the transverse wall 410, the transverse wall 412, and/or the transverse wall 414 (e.g., and thus having only one or two tanks on the inlet side of the accumulator 106). In one or more implementations, when a vapor portion of the refrigerant reaches the external wall 405, the vapor portion of the refrigerant may be redirected to an opposing side of the first internal wall 408 and back toward the outlet opening 306 in the housing 300 (e.g., as indicated by the flow path 308 of FIG. 3).

Figure 5:
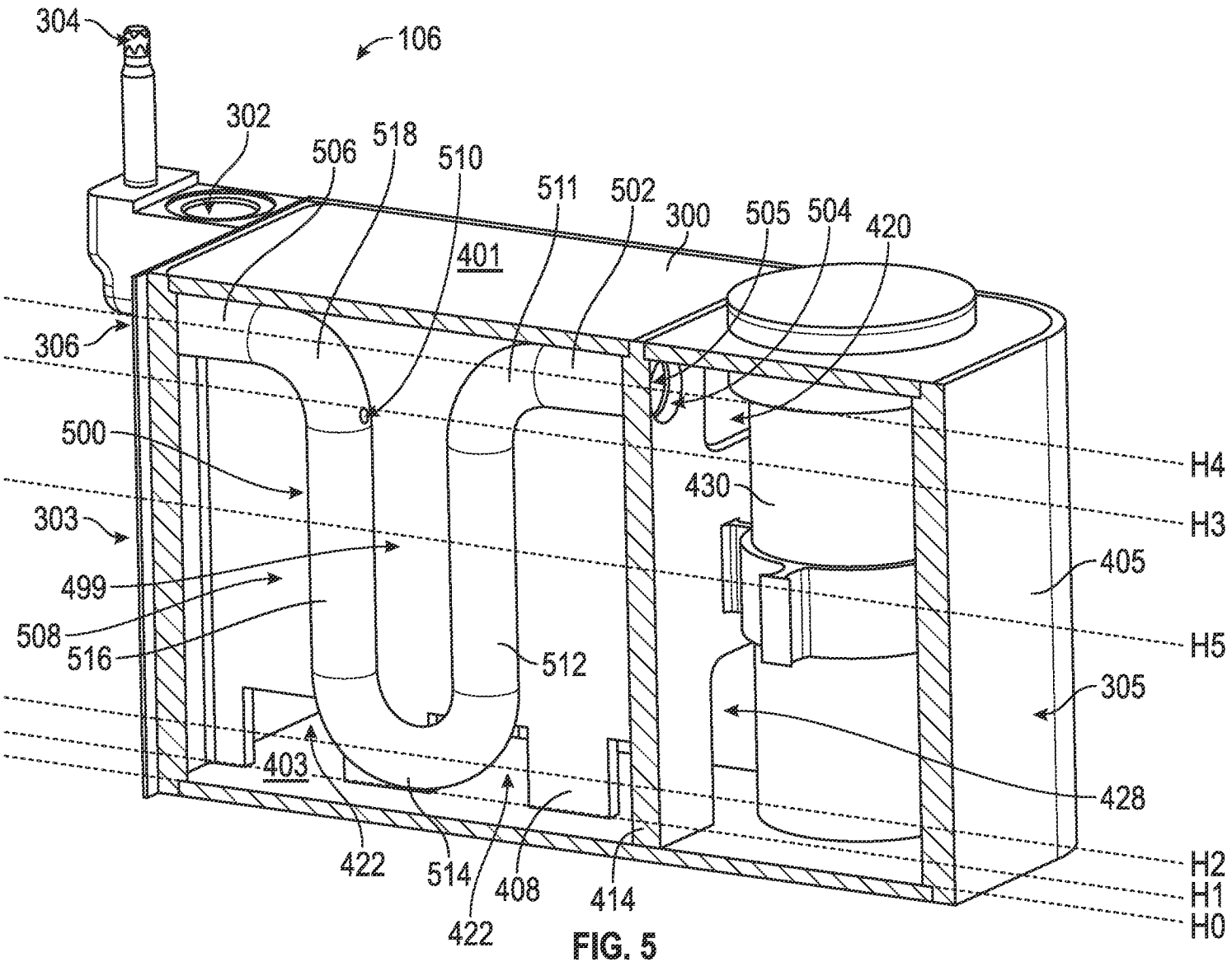
FIG. 5 illustrates a cross-sectional side perspective view of the accumulator of FIG. 3, as viewed from a second side of the accumulator in accordance with one or more implementations.

For example, FIG. 5 illustrates a cross-sectional perspective side view of the accumulator 106 from an opposing side of the accumulator 106, in which the opposing side of the first internal wall 408 can be seen. As shown in FIG. 5, the accumulator 106 may include a multidimensional tube, such as a u-tube 500. As shown, the multidimensional tube (e.g., the u-tube 500) may be disposed on the opposing side of the first internal wall 408 (e.g., in an outlet path portion of the cavity 499). For example, the u-tube 500 may include a u-shaped section 508 that fluidly couples an inlet section 502 of the u-tube to an outlet section 506 of the u-tube and extends in a direction substantially orthogonal to both the inlet section 502 and the outlet section 506.

As shown in FIG. 5, the inlet section 502 may be a horizontal inlet section, the outlet section 506 may be a horizontal outlet section, and the u-shaped section 508 may be a substantially vertical u-shaped section that extends vertically downward from the horizontal inlet section and the horizontal outlet section. For example, the inlet section 502 may be located at or near a top of the cavity 499 to receive a vaporized refrigerant. For example, the inlet section 502 and the outlet section 506 may be mounted at a height (H4) within the accumulator 106 (e.g., within the housing 300, such as within the cavity 499 defined by the housing 300). For example, a floor 403 of the housing 300 may define a height H0. The height H4 may be defined as a height above the height H0 (e.g., a distance from the floor 403 of the housing, such as in a direction perpendicular to the floor 403). For example, providing the inlet section 502 and the outlet section 506 at the same height H4 (e.g., the same distance from the floor 403) within the housing 300 may help to reduce or eliminate a pressure drop in the vaporized refrigerant that can occur in existing accumulator arrangements (e.g., cylindrical accumulator arrangements, and/or arrangements with a J-tube rather than a u-tube). For example, providing the inlet section 502 implemented with a substantially horizontal tube portion and the outlet section 506 with a substantially horizontal tube portion at the same height H4 (e.g., the same distance from the floor 403) within the housing 300 may further help to reduce or eliminate a pressure drop in the vaporized refrigerant that can occur in existing accumulator arrangements (e.g., cylindrical accumulator arrangements, or arrangements with a J-tube rather than a u-tube). The height H4 at which the inlet section 502 and the outlet section 506 are mounted may allow an increased amount of liquid refrigerant to be stored in the cavity 499. Providing the u-tube 500 within the housing 300 (e.g., a cuboid housing) may reduce or eliminate a need for an outlet chamber within the cavity 499 that includes constrained openings for creating vapor flows and oil pickup and that can induce pressure drops in the refrigerant.

As shown, the u-shaped section 508 may extend (e.g., downward) from the inlet section 502 and the outlet section 506 to a height H1 within the housing 300 (e.g., a distance, H1, from the floor 403). In one or more implementations, the u-tube 500 may include a bleeding hole 510. For example, the bleeding hole 510 may be provided to ensure proper functioning of the accumulator after a period of inactivity of the heat pump system 104, during which a relatively large amount of liquid refrigerant may have accumulated in the cavity 499. As shown, the bleeding hole 510 may be mounted at a height H3 (e.g., a distance, H3, from the floor 403) within the accumulator 106. For example, the height H3 (e.g., the distance, H3, from the floor 403) may be between the height H4 (e.g., the distance, H4, from the floor 403) and the height H1 (e.g., the distance, H1, from the floor 403) of the bottom of the u-shaped section 508 (e.g., and nearer the height H4 than the height H1).

In one or more implementations, the u-tube 500 may also include an orifice in the u-shaped section 508. For example, the orifice may be mounted at a height H2 (e.g., a distance, H2, from the floor 403), lower than the height H4 (e.g., less than the distance H4 from the floor 403 and more than the distance, H1, from the floor 403), within the accumulator 106. For example, the orifice may be configured (e.g., sized and positioned) to allow oil that is in the lower portion (e.g., below a height H5 that is between the height H3 and the height H2) of the cavity 499 within the accumulator to flow therethrough (e.g., into the u-shaped section 508 of the u-tube 500) and be picked up by the vaporized refrigerant flowing through the u-tube 500. For example, oil from the cavity 499 may flow into the u-tube 500 due to a pressure difference across the orifice. In this arrangement, the outlet section 506 is configured to outlet the vaporized refrigerant that entered the u-tube through the inlet section 502, mixed with at least some of the oil that enters through the orifice.

Figure 6:
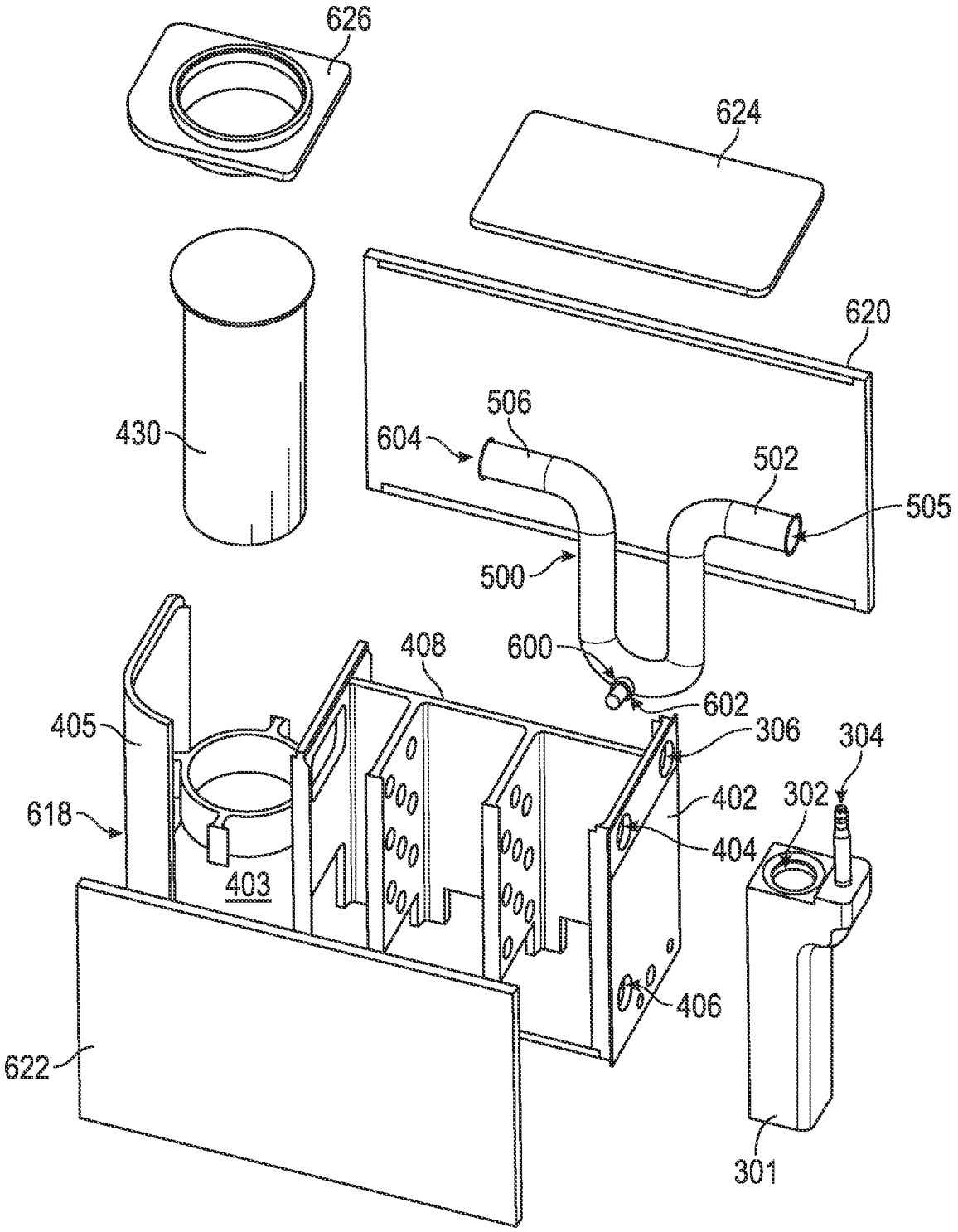
FIG. 6 illustrates an exploded perspective view of the accumulator of FIG. 3 in accordance with one or more implementations.

In the example of FIG. 5, the orifice is located on a side of the u-tube 500 that is not visible in FIG. 5 (see, e.g., FIG. 6).

As shown in FIG. 5, the u-shaped section 508 may include a u-shaped bottom section 514. As shown, first and second parallel vertical sections 512 and 516 may be fluidly coupled to opposing ends of the u-shaped bottom section 514. As shown, the u-shaped section 508 may also include first and second curved sections 511 and 518 that respectively fluidly couple the first and second parallel vertical sections 512 and 516, respectively, to the inlet section 502 and the outlet section 506. As shown in FIG. 5, the u-tube 500 may include an inlet opening 505 within the housing 300. In the example of FIG. 5, the inlet opening 505 is mounted in an opening 504 within the transverse wall 414. However, in other implementations, the inlet opening 505 may be floating within the housing 300 (e.g., not directly supported by a support structure such as the transverse wall 414), or may be supported by another support structure within the housing 300. As shown, on the side of the accumulator 106 that is visible in FIG. 5, the transverse wall 414 may extend to the floor 403 of the housing, to encourage vaporized refrigerant to flow into the inlet opening 505 of the u-tube.

FIG. 6 illustrates an exploded top perspective view of the accumulator 106, in accordance with one or more implementation. The view of FIG. 6 is depicted from the side of the accumulator 106 in which the same side of the first internal wall 408 that is visible in FIG. 4 is visible. In this orientation, the orifice 600 in the u-tube 500 (e.g., in the u-shaped section 508 at a height H2, as discussed herein in connection with FIG. 5) can be seen. As shown in FIG. 6, a filter 602 may be disposed over the orifice 600 (e.g., to prevent dust particles or other debris from passing through and/or blocking the orifice 600).

In the example of FIG. 6, the housing 300 may be formed from multiple parts (e.g., that are welded together), including a first sidewall 620 (e.g., a first rectilinear sidewall), a second sidewall 622 (e.g., a second rectilinear sidewall), a top cover 624, a desiccant port 626 (e.g., for replacing the desiccant bag 430), and a structural component 618 (e.g., including the floor 403, the first internal wall 408, the transverse walls, the exterior proximal wall 402, and the external wall 405). However, this is merely illustrative, and the housing 300 may be formed from other components, and/or may be formed as a unitary (e.g., molded) housing).

As illustrated in FIGS. 3-6, in one or more implementations, an accumulator 106 may be provided (e.g., for a heat pump system, such as the heat pump system 104), in which the accumulator 106 includes a u-tube 500 mounted within a housing 300 (e.g., a cuboid housing). The u-tube 500 may include an (e.g., horizontal) inlet section 502 at a first distance (e.g., H4) from the floor 403 of the housing 300 and having an opening 505 within the housing 300 (e.g., floating within the housing 300, or mounted within an opening 504 in a support structure, such as transverse wall 414); an (e.g., horizontal) outlet section 506 at the first distance (e.g., H4) from the floor of the housing 300 and having an opening 604 mounted in an outlet opening 306 in the housing; and a (e.g., substantially vertical) u-shaped section 508 that fluidly couples the inlet section 502 to the outlet section 506 and extends to a second distance (e.g., H1), less than the first distance from the floor 403 of the housing 300. The u-tube 500 may also include an orifice 600 in the (e.g., substantially vertical) u-shaped section 508. The accumulator 106 may also include a filter 602 mounted over the orifice 600. For example, the orifice 600 may be mounted at a third distance (e.g., H2) from the floor 403 of the housing 300, the third distance less than the first distance (e.g., H4). The u-tube may also include a bleeding hole 510 mounted at a fourth distance (e.g., H3) from the floor 403 of the housing 300, the fourth distance being between the first distance (e.g., H4) and the third distance (e.g., H2).

Figure 7:
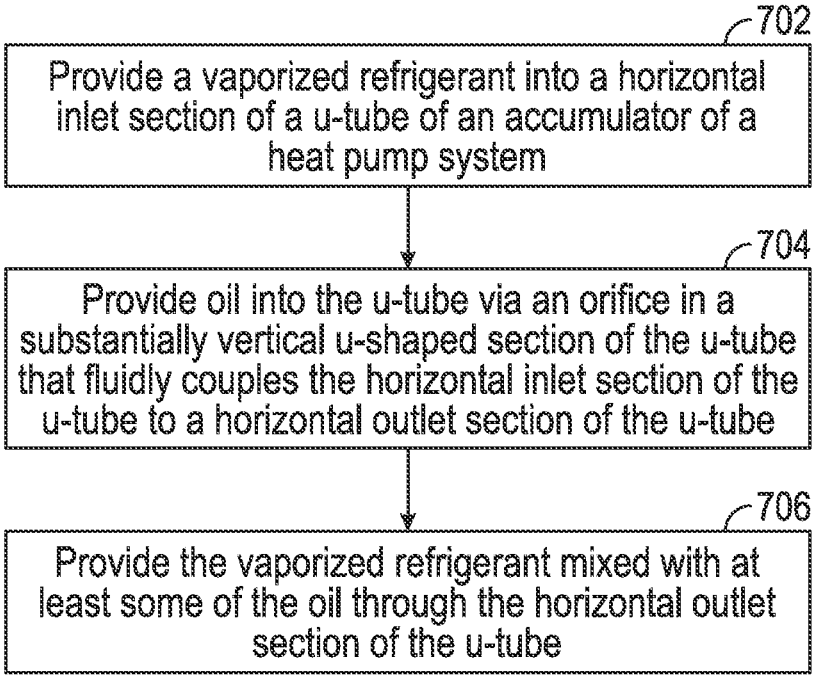
FIG. 7 illustrates a flow chart of illustrative operations that may be performed for operating a heat pump system having an accumulator in accordance with one or more implementations.

FIG. 7 illustrates a flow diagram of an example process for operating a heat pump system, in accordance with implementations of the subject technology. For explanatory purposes, the process 700 is primarily described herein with reference to the accumulator 106 of FIGS. 3-6. However, the process 700 is not limited to the accumulator 106 of FIGS. 3-6, and one or more blocks (or operations) of the process 700 may be performed by one or more other structural components of other suitable moveable apparatuses, devices, or systems. Further for explanatory purposes, some of the blocks of the process 700 are described herein as occurring in serial, or linearly. However, multiple blocks of the process 700 may occur in parallel. In addition, the blocks of the process 700 need not be performed in the order shown and/or one or more blocks of the process 700 need not be performed and/or can be replaced by other operations.

As illustrated in FIG. 700, at block 702, a vaporized refrigerant may be provided into a horizontal inlet section (e.g., inlet section 502) of a u-tube (e.g., u-tube 500) of an accumulator (e.g., accumulator 106) of a heat pump system (e.g., heat pump system 104). For example, the vaporized refrigerant may be received at the accumulator from one or more evaporators, such as one or more heat exchangers (e.g., one or more of heat exchanger 206, heat exchanger 207, heat exchanger 202, or heat exchanger 209)

At block 704, oil may be provided into the u-tube via an orifice (e.g., orifice 600) in a substantially vertical u-shaped section (e.g., u-shaped section 508) of the u-tube that fluidly couples the horizontal inlet section of the u-tube to a horizontal outlet section of the u-tube. For example, the oil may occupy a lower portion of a cavity defined within a housing of the accumulator through which a lower portion of the u-tube (e.g., a lower portion including the orifice) passes).

At block 706, the vaporized refrigerant mixed with at least some of the oil (e.g., by pickup of the oil by the flow or the vaporized refrigerant through the u-tube) may be provided through the horizontal outlet section of the u-tube (e.g., to a compressor, such as compressor 200 of FIG. 2A or 2B).

In one or more implementations, the process 700 may also include providing liquid refrigerant into the accumulator (e.g., via an inlet port 302 or an inlet port 304 and/or via an inlet opening 404 and/or an inlet opening 406 in the housing 300); and storing the liquid refrigerant in a portion of the accumulator through which the substantially vertical u-shaped section of the u-tube passes (e.g., a lower portion of the accumulator, such as a portion of the cavity 499 below a height H5 within the housing 300).

In one or more implementations, the process 700 may also include compressing (e.g., by a compressor 200) the vaporized refrigerant provided through the horizontal outlet section of the u-tube to form a liquid refrigerant; and controlling, using the liquid refrigerant (e.g., with a heat exchanger 206), a temperature (e.g., by cooling as discussed herein in connection with FIG. 2A, or by heating as discussed herein in connection with FIG. 2B) of at least one of a passenger compartment (e.g., passenger compartment 108) or a battery (e.g., battery 110) of a vehicle (e.g., and/or power electronics of the vehicle).

In one or more implementations, the accumulator 106 as described herein may provide a reliable and robust mechanism of liquid and gas separation with a with high refrigerant mass flow, a reduced pressure drop of the refrigerant across the accumulator before entering the compressor, and sufficient oil pickup to the refrigerant for lubrication before entering the compressor. By controlling the oil pickup (e.g., via the orifice 600), the operable lifetime of the compressor (e.g., compressor 200) may be extended. By reducing the pressure drop in the refrigerant, the load on the compressor (e.g., compressor 200) may be reduced. By reducing the compressor load, the coefficient of performance (COP) of the entire heat pump system may be improved.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f), unless the element is expressly recited using the phrase "means for" or, in the case of a method claim, the element is recited using the phrase "step for".

Those of skill in the art would appreciate that the various illustrative blocks, modules, elements, components, methods, and algorithms described herein may be implemented as hardware, electronic hardware, computer software, or combinations thereof. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way) all without departing from the scope of the subject technology.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language of the claims and to encompass all legal equivalents. Notwithstanding, none of the claims are intended to embrace subject matter that fails to satisfy the requirements of the applicable patent law, nor should they be interpreted in such a way.

What is claimed is:

1. An apparatus, comprising:

a multi-dimensional tube for an accumulator of a heat pump system, the multi-dimensional tube comprising:

an inlet section configured to be mounted within a housing of the accumulator and to receive a vaporized refrigerant from within the housing; and a u-shaped section that is configured to be mounted within the housing of the accumulator and that fluidly couples the inlet section of the multi-dimensional tube to an outlet section, within the housing of the accumulator, of the multi-dimensional tube and extends in a direction that is orthogonal to the inlet section and orthogonal to the outlet section.

2. The apparatus of claim 1, wherein the multi-dimensional tube further comprises an orifice in the u-shaped section.

3. The apparatus of claim 2, wherein the the orifice is configured to allow oil to flow therethrough, and the outlet section is configured to outlet the vaporized refrigerant mixed with at least some of the oil.

4. The apparatus of claim 2, wherein the inlet section and the outlet section are configured to be mounted at a first distance from a floor of the accumulator.

5. The apparatus of claim 4, wherein the orifice is configured to be mounted at a second distance from the floor, the second distance less than the first distance.

6. The apparatus of claim 5, wherein the multi-dimensional tube further comprises a bleeding hole configured to be mounted at a third distance from the floor, the third distance between the first distance and the second distance within the accumulator.

7. The apparatus of claim 6, wherein the u-shaped section comprises:

a u-shaped bottom section;

first and second parallel vertical sections fluidly coupled to opposing ends of the u-shaped bottom section; and first and second curved sections that respectively fluidly couple the first and second parallel vertical sections, respectively, to the inlet section and the outlet section.

8. An accumulator for a heat pump system, the accumulator comprising:

a u-tube mounted within a housing, the u-tube comprising:

an inlet section at a first distance from a floor of the housing and having an inlet opening within the housing at an end of the inlet section;

an outlet section at the first distance from the floor of the housing and having an opening mounted in an outlet opening in the housing; and a u-shaped section that fluidly couples the inlet section to the outlet section and extends to a second distance from the floor, the second distance less than the first distance.

9. The accumulator of claim 8, wherein the u-tube further comprises an orifice in the u-shaped section.

10. The accumulator of claim 9, further comprising a filter mounted over the orifice.

11. The accumulator of claim 9, wherein the orifice is mounted at a third distance from the floor, the third distance less than the first distance.

12. The accumulator of claim 11, wherein the u-tube further comprises a bleeding hole mounted at a fourth distance from the floor, the fourth distance between the first distance and the third distance.

13. The accumulator of claim 8, wherein the housing comprises a cavity that forms a container configured to store a fluid portion of a refrigerant, and wherein the u-tube is configured to pass a vaporized portion of the refrigerant.

14. The accumulator of claim 13, further comprising:

the housing;

an inlet opening in the housing;

the outlet opening in the housing; and a first internal wall within the housing, wherein a proximal end of the first internal wall is attached to the housing between the inlet opening in the housing and the outlet opening and the first internal wall is configured to guide the vaporized portion of the refrigerant through a cavity within the housing.

15. The accumulator of claim 14, wherein the first internal wall comprises at least one opening at or near a base thereof, the opening configured to allow liquid to pass under the first internal wall.

16. The accumulator of claim 14, further comprising:

a desiccant bag at or near a distal end of the first internal wall; and an additional inlet opening in the housing.

17. The accumulator of claim 8, wherein the accumulator is disposed in the heat pump system, and wherein the heat pump system is disposed in an electric vehicle.

18. A method, comprising:

providing a vaporized refrigerant from within a housing of an accumulator of a heat pump system into a horizontal inlet section of a u-tube that is disposed within the accumulator of the heat pump system;

providing oil into the u-tube via an orifice in a substantially vertical u-shaped section of the u-tube that fluidly couples the horizontal inlet section of the u-tube to a horizontal outlet section of the u-tube; and providing the vaporized refrigerant mixed with at least some of the oil through the horizontal outlet section of the u-tube.

19. The method of claim 18, further comprising:

providing liquid refrigerant into the accumulator; and storing the liquid refrigerant in a portion of the accumulator through which the substantially vertical u-shaped section of the u-tube passes.

20. The method of claim 19, further comprising:

compressing the vaporized refrigerant provided through the horizontal outlet section of the u-tube to form a liquid refrigerant; and controlling, using the liquid refrigerant, a temperature of at least one of a passenger compartment or a battery of a vehicle.

* * * * *